US005124675A

United States Patent [19]

Komazaki et al.

[11] Patent Number: 5,124,675

[45] Date of Patent: Jun. 23, 1992

[54] LC-TYPE DIELECTRIC FILTER

[75] Inventors: Tomokazu Komazaki; Katsuhiko Gunji; Norio Onishi; Ichiro Iwase; Akira Mashimo, all of Tokyo, Japan

[73] Assignee: Electric Industry Co., Ltd., Tokyo, Japan

[21] Appl. No.: 584,176

[22] Filed: Sep. 18, 1990

Related U.S. Application Data

[62] Division of Ser. No. 480,054, Feb. 14, 1990, abandoned.

[30] Foreign Application Priority Data

Feb. 16, 1989 [JP] Japan ..... 1-35129
Dec. 1, 1989 [JP] Japan ..... 1-312370

[51] Int. Cl.[5] ..... H01P 1/203
[52] U.S. Cl. ..... 333/204; 333/219
[58] Field of Search ..... 333/174, 175, 185, 202, 333/204, 205, 206, 219.1, 246, 219

[56] References Cited

U.S. PATENT DOCUMENTS 3,959,749 5/1976 Ikushima et al. ..... 333/204
4,429,289 1/1984 Higgins, Jr. et al. ..... 333/202
4,673,902 6/1987 Takeda et al. ..... 333/202
4,703,291 10/1987 Nishikawa et al. ..... 333/204 X
4,757,286 7/1988 Konishi et al. ..... 333/204
4,937,542 6/1990 Nakatuka ..... 333/204 X

FOREIGN PATENT DOCUMENTS 7828985 5/1980 France .
59-27601 2/1984 Japan .
0065601 4/1985 Japan ..... 333/202
61-28201 2/1986 Japan .
63-119302 5/1988 Japan .
0091502 4/1989 Japan ..... 333/219.1

*Primary Examiner*—Eugene R. Laroche
*Assistant Examiner*—Seung Ham
*Attorney, Agent, or Firm*—Spencer, Frank & Schneider

[57] ABSTRACT

An LC-type dielectric filter which includes strip lines on a dielectric plate forming distributed constant type resonators. The strip lines and other elements of the filter, such as coupling capacitances are plated onto the dielectric plate as printed circuits to realize a small, high-Q dielectric filter which is suitable for mass-production.

3 Claims, 12 Drawing Sheets

LC-TYPE DIELECTRIC FILTER

This is a division of application Ser. No. 07/480,054 filed Feb. 14, 1990, now abandoned.

REFERENCE TO RELATED APPLICATIONS

This application claims rights of priority under 35 U.S.C. 119 of Japanese application Ser. No. 35129/89, filed on Feb. 16, 1989 and a Japanese Application entitles "Hybrid Filter" filed on Dec. 1, 1989, the entire disclosures of which are hereby incorporated by reference.

BACKGROUND OF THE INVENTION

1. Field of the Invention

This invention relates to an LC-type dielectric filter utilized in microwave band communication and more particularly to an LC-type dielectric filter using strip lines for resonators.

2. Brief Description of the Related Art

Recently, high frequency microwave band communications have had a great role in mobile communication systems, for example, in the recently developed cellular telephone systems. In this technology, since communications systems require several hundreds of frequency channels in the approximately 800 MHz frequency band, there has long been a need for a small filter, having a high quality factor or high-Q, and less parasitic capacity, and which is suitable for mass-production.

One example of a conventional filter is disclosed in an article entitled "Dielectric Filter having Attenuation Pole for Microwave Band", OKI ELECTRIC INDUSTRY CO., Research & Development, No 144, Vol. 56, No. 1 published on Jan. 1, 1989.

FIG. 1 illustrates a four resonator type uni-block dielectric filter disclosed in the above mentioned article. As shown in FIG. 1, the filter comprises a single rectangular dielectric block $D_1$. The dielectric block $D_1$ has four cylindrical holes $H_1$ to $H_4$ having metalized interior surfaces and metalized portions $M_1$ to $M_{10}$ on the block surfaces, with the metalized portions $M_2$, $M_4$, $M_6$ and $M_8$ connected to the metalized interior surfaces.

In this configuration of FIG. 1, each of the holes performs as a short-circuited $\frac{1}{4}$ wavelength coaxial resonator. The respective spaces between the metalized portions $M_3$, $M_5$, and $M_7$, and the metalized portions $M_2$, $M_4$, and $M_6$ perform the function of coupling capacitances between the resonators.

FIG. 2(*a*) and FIG. 2(*b*) illustrate another example of a conventional dielectric filter, which is disclosed in Japanese Kokai publication No. 62-265658 published on Nov. 18, 1987, wherein FIG. 2(*a*) illustrates a front side of the filter and FIG. 2(*b*) illustrates a reverse side of the filter.

As shown in FIG. 2(*a*), a main body of the filter comprises a dielectric plate $D_2$ having four through holes $H_5$ to $H_8$. Further, on the front side of the dielectric plate $D_2$, there are provided three spiral printed coils $L_{1A}$, $L_{2A}$, and $L_{3A}$ for inductance of the filter and three metalized portions $C_{1A}$, $C_{2A}$, and $C_{3A}$ for capacitance of the filter. Each of the inductances and capacitances is electrically combined with a corresponding similar configuration provided on the reverse side of the dielectric plate $D_2$.

As shown in FIG. 2(*b*) on the reverse side of the dielectric plate $D_2$, there are provided four metalized portions $C_{1B}$, $C_{2B\text{-}1}$, $C_{2B\text{-}2}$, and $C_{3B}$ which are coupled with the above mentioned metalized portions $C_{1A}$, $C_{2A}$, and $C_{3A}$ via the dielectric material of the dielectric plate $D_2$ for forming capacitors of the filter. Further, there are provided three printed coils $L_{1B}$, $L_{2B}$, and $L_{3B}$ for forming inductors of the filter. According to this configuration, because the diameters of the coils on each side are different, the parasitic capacitance between the coils can be reduced and the frequency characteristic of the filter can be improved, as is described in detail in the Japanese Kokai Publication.

However, the above-mentioned conventional dielectric filters have certain disadvantages.

As to the first example shown in FIG. 1, it is very difficult to make a cylindrical hole in the dielectric block with sufficient accuracy because the dielectric material is very hard. Especially, when an adjustment of the filter is to be made, it is necessary to scrape the dielectric material which, in many cases, consists of very hard ceramics. Such a material is difficult to scrape even with a carbon silicon scraper. Further, it is also difficult to metalize the inner surfaces of the holes by plating. Therefore, this dielectric filter is not suitable for large scale production.

As to the second example shown in FIGS. 2(*a*) and 2(*b*), even though this type of filter is easy to make because conventional methods of manufacturing printed circuit boards may be applied, there is a fundamental problem: an amount of parasitic impedance will always be present because in a filter featuring one or more spiral coils each coil itself has parasitic impedance, such as stray capacitance between its electrodes.

Therefore, in fact, the quality factor of this kind of filter when not loaded may be up to approximately 100. This is why the filter is applicable for use only under the approximately 500 MHz frequency band. If the frequency exceeds 500 MHz, the parasitic impedance increases at an approximately exponential rate and it cannot satisfy the necessary frequency characteristic.

OBJECT AND SUMMARY OF THE INVENTION

An object of the invention is to provide a small and high-Q LC-type dielectric filter featuring a plurality of parallel LC-type resonators which are comprised of strip lines.

Another object of the invention is to provide an LC-type dielectric filter which is suitable for mass-production because all of elements of the filter are manufacturable by metal plating on a dielectric plate.

The LC-type filter according to the invention comprises a single dielectric plate on which is formed a printed circuit which includes a conductive layer forming a ground portion, an input terminal, an output terminal, at least first and second strip lines forming a pair of distributed constant resonators, one end of each of the strip lines being connected to the ground portion, a first coupling circuit coupling the other end of the first strip line and the input terminal, a second coupling circuit coupling the other end of the second strip line and the output terminal, and at least one third coupling circuit coupling together the other ends of the first and second strip lines.

In the filter according the invention, each of the strip lines is provided by plating as a distributed constant resonator circuit, such as a $\frac{1}{2}$ or $\frac{1}{4}$ wave length resonator. Generally, a strip line circuit on a dielectric material is low-loss and has a high quality factor. Therefore, it becomes possible to realize a small and high-Q filter.

Further, since the other circuit elements such as coupling capacitors, connecting electrodes, and input/output terminals provided as plated through holes, can be easily provided by the same process, it becomes easy to make a dielectric filter which is suitable for mass-production.

BRIEF DESCRIPTION OF THE DRAWINGS

These and other aspects of the invention may be more completely understood from the following detailed description of the preferred embodiments with reference to the accompanying drawings in which:

FIG. 3(*d*) and FIG. 3(*e*) are respectively a sectional view and a bottom surface of a resonator of the first embodiment of the invention;

FIG. 4(*b*) is a partial front view of the modification illustrated in FIG. 4(*a*);

FIG. 7(*b*) is a front view of the modification illustrated in FIG. 7(*a*);

DESCRIPTION OF THE PREFERRED EMBODIMENT

First Embodiment

Figure 1:
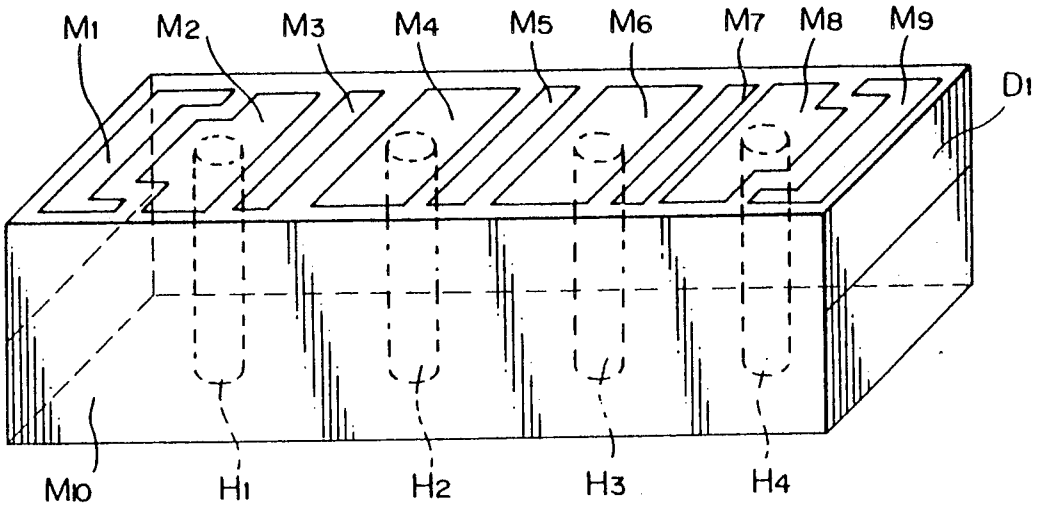
FIG. 1 illustrates a first example of a conventional dielectric filter.

As shown in FIG. 3(*a*) and FIG. 3(*b*), a filter of the first embodiment is comprised of a dielectric plate $D_3$ and five dielectric resonators $R_1$, $R_2$, $R_3$, $R_4$, and $R_5$, each of which is a combination of a dielectric block 36-*n* and a strip line 38-*n* plated on the dielectric block (n = 1, 2, . . . 5) on the dielectric plate $D_3$.

The dielectric plate $D_3$ is made of a glass-epoxy resin and has a thickness of 1.0 mm. Such a plate has a relatively low dielectric constant (specific inductive capacitance) $\epsilon_r$ of approximately 4.5.

On the dielectric plate $D_3$, there are plated metalized portions 12, 12' to function as ground. Further, all of the side surfaces (one of which is shown in FIG. 3(*b*)) are also metalized to reduce filter loss and to improve the frequency characteristic.

Five metal plated through holes, including an input terminal IN, an output terminal OUT and three additional through holes 20, are provided for electrical connection. The terminals and three additional through holes extend from the upper surface to the reverse surface of the dielectric plate $D_3$.

Further, there are provided three pairs of opposite square metal plated portions (14, 14'), (16, 16'), and (18, 18'), with one metal plated portion of each pair being formed on each of the upper and the reverse surfaces of the dielectric plate $D_3$ to provide capacitors 15, 17, and 19, respectively. The capacitors 15 and 17 have the same value of capacitance $C_0$ and the capacitor 19 has a value of capacitance $C_4$. In this way, there can be provided relatively high capacitance capacitors.

Further, there are metal plated three pairs of opposite line-shaped capacitor electrodes (22, 24), (26, 28), and (30, 32) on the upper surface of the dielectric plate $D_3$, for forming coupling capacitors 25, 29 and 33, respectively.

The capacitors 25 and 33 have the same value of capacitance $C_{12}$. The capacitor 29 has a value of capacitance $C_{23}$. The capacitances of capacitors 25, 29 and 33 are smaller than those of capacitors 15, 17, and 19 and are therefore provided in different configurations.

Each of the above mentioned elements are interconnected by respective printed circuits 34.

As shown in FIGS. 3(*a*)–3(*c*), each of the microstrip resonators $R_1$ to $R_5$ comprises a combination of the small dielectric block 36-*n* of thickness 1.0 mm and a strip form electrode (hereinafter, strip line) 38-*n* (n = 1,2,3,4,5) plated on a center of a front surface 13*a*, back surface 13*b*, and upper surface 13*c* of the dielectric block. As shown in FIG. 3(*e*), which illustrates a bottom surface of a microstrip resonator, all but a small part of the bottom surface 13*d* and opposite left and right side surfaces 13*e* and 13*f* of the dielectric block are fully metalized to contact the metalized portion 12 for grounding and an improved frequency characteristic. The only portion of the bottom surface which is not metalized is an exposed portion 39 at the end of the strip line 38-*n*, which is provided to avoid short circuiting of the resonator.

As shown in FIG. 3(*d*), which is a sectional view of the filter in a plane through the dielectric plate $D_3$ and a resonator, one end of each of the strip lines 38-*n* is connected to the corresponding printed circuit 34 at a location adjacent to the back surface of the corresponding block 36-*n* via a soldered portion 35, and the other end of each of the strip lines 38-*n* is also connected to the metalized portion 12 for grounding.

Figure 2A:
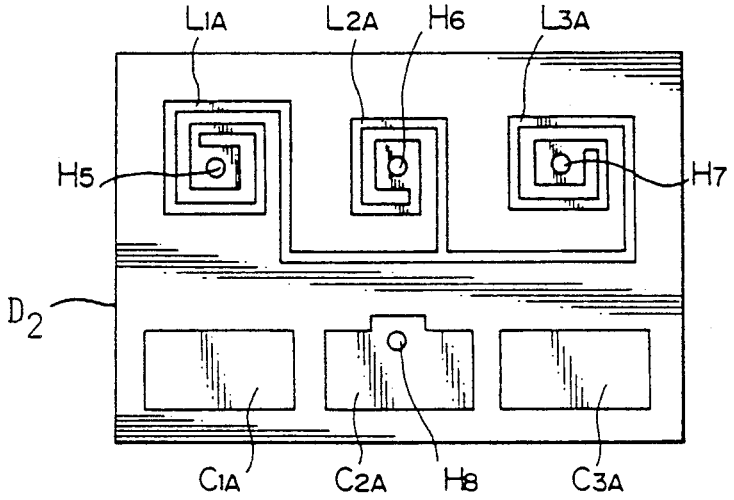
PRIOR ART Fig.2(a)
FIG. 2(*a*) and FIG. 2(*b*) are respectively upper and reverse side views of a second example of the conventional dielectric filter.
Figure 2B:
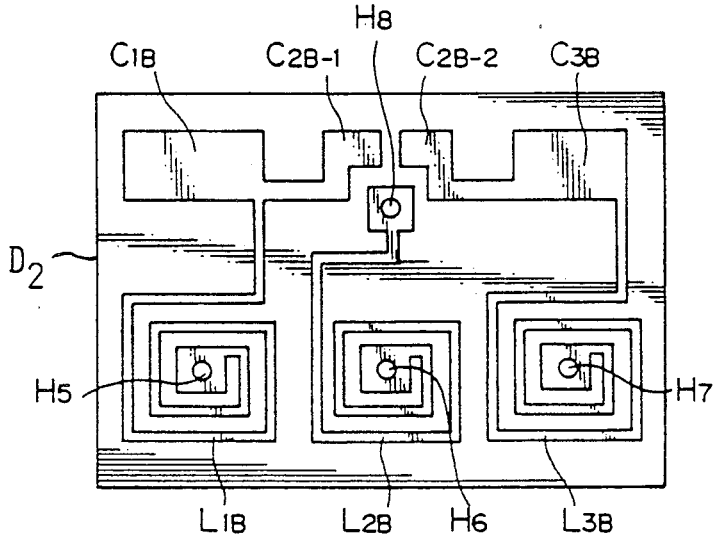
PRIOR ART Fig.2(b)
Figure 3A:
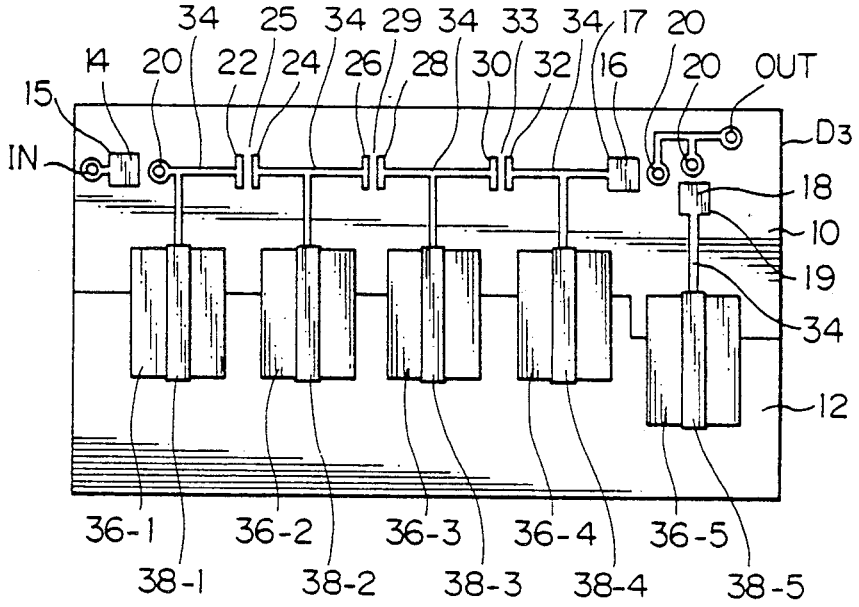
FIG. 3(*a*), FIG. 3(*b*), and FIG. 3(*c*) are respectively upper, side and reverse side views of a first embodiment of the invention.
Figure 3B:
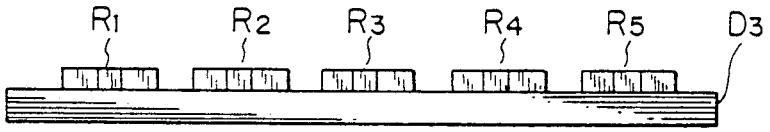
Figure 3C:
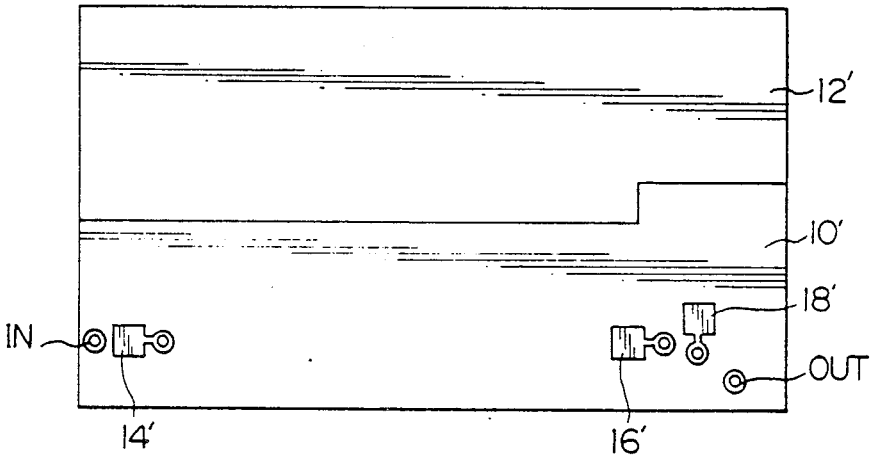
Figure 3D:
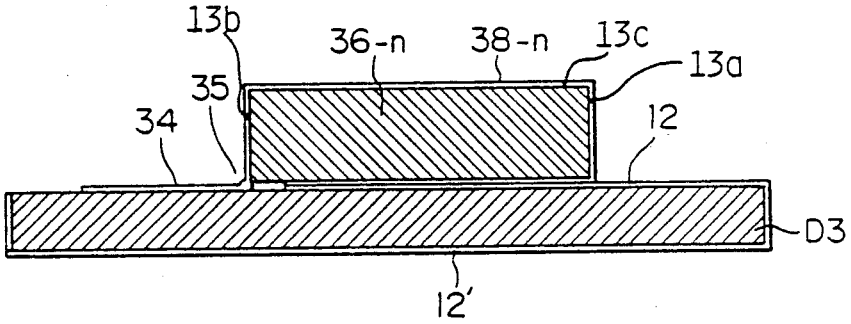
Figure 3E:
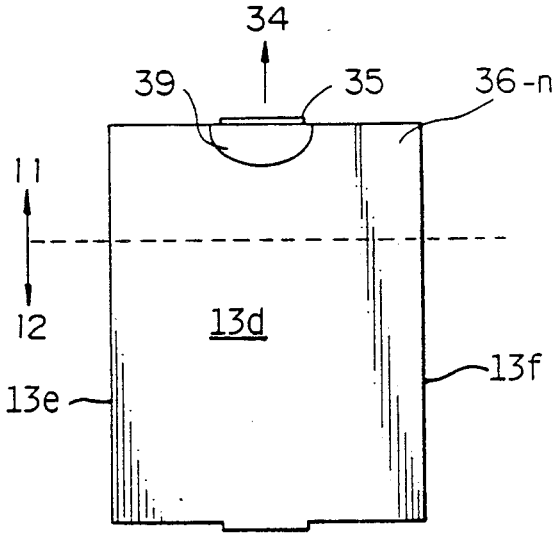

In this embodiment, the dielectric material used in the dielectric blocks is dielectric ceramic which has a dielectric constant of approximately 75. Generally, the higher the dielectric constant of the material the higher its cost. Therefore, in the first embodiment, a relatively low dielectric constant material such as glass-epoxy resin is used for the printed circuit board including capacitors, and the relatively high dielectric constant material such as ceramics is used only for the resonators themselves which should have a high dielectric constant. This of course reduces the overall cost in comparison with the conventional single dielectric plate filter formed of the more expensive ceramics, such as the dielectric filter illustrated in FIGS. 2(*a*) and 2(*b*).

The length of the strip lines 38-*n* is one fourth of the wave length of the applied frequency for resonance. The following is an analysis of the filter of the invention.

Analysis

Generally, an input impedance $Z_{in}$ of a short circuited strip line is given by:

$$Z_{in}=jZ_0 \tan \beta l \quad (1)$$

where, $\beta$ is a phase constant, l is a strip length, $Z_0$ is a characteristic impedance of the strip line and j is the imaginary number, the square root of minus one. This circuit resonates at an angular frequency $\omega_c$ which satisfy the following equation:

$$\omega_c = \beta l = \frac{(2n-1)\pi}{2} \quad (n = 1, 2, 3 \ldots) \quad (2)$$

At the angular frequency $\omega_c$, the input impedance $Z_{in}$ becomes infinite. Further, at a frequency around the $\omega_c$, the strip line becomes equivalent to a parallel resonator circuit and satisfies the following equation:

$$\omega_c = \frac{1}{\sqrt{L_c C_c}} \quad (3)$$

where, $L_c$ and $C_c$ represent an inductance component and a capacitance component respectively of the equivalent circuit of the parallel resonator circuit. According to this relation, with the strip line short circuited the equivalent becomes that of a primarily inductive resonator circuit below the resonant frequency. Further, $L_c$, $C_c$, $Z_0$, and $\beta l$ satisfy the following relations.

$$\frac{1}{\omega L_c} = \frac{1}{Z_0} \frac{2\beta l + \sin 2\beta l}{4\sin^2 \beta l} \quad (4)$$

$$\omega C_c = \frac{1}{Z_0} \frac{2\beta l - \sin 2\beta l}{4\sin^2 \beta l} \quad (5)$$

In equations (4) and (5), if $\omega=\omega_c=2\pi f_c$, $\beta l$ must be $(2n-1)\pi/2$. In that case, $L_c$ and $C_c$ are as follows:

$$L_c = \frac{2Z_0}{\pi^2 f_c(2n-1)}, \quad C_c = \frac{2n-1}{8f_c Z_0} \quad (6)$$

As a specific example, if $Z_0=50\ \Omega$ and $f_c=1.5$ GHz, $L_c$ becomes 6.76 nH and $C_c$ becomes 1.67 pF.

In general, the equation for the inductance L of a parallel LC circuit is given by $L_c/(1-\omega^2 L_c C_c)$. For a parallel LC circuit, in which the frequency is below the resonant frequency $f_c$, the equivalent circuit is primarily inductive and for an input signal frequency of 800 MHz and the resonant frequency $f_c=1.5$ GHz, the inductance L becomes:

$$L = \frac{L_c}{1-\omega^2 L_c C_c} = \frac{6.76}{0.716} = 9.4 \text{ nH} \quad (7)$$

On the other hand, if the ends of the strips are opened, the equivalent circuit becomes a capacitance circuit. In general, the input impedance $Z_{in}$ becomes:

$$Z_{in}=-jZ_0 \cot \beta l \quad (8)$$

Thus, $Z_{in}$ becomes zero and the circuit resonates at a frequency of:

$$\omega_c = \beta l = \frac{(2n-1)\pi}{2} \quad (n = 1, 2, 3 \ldots) \quad (9)$$

The equivalent circuit of the open circuited strip line is a series resonator circuit which is primarily capacitive at input frequencies under the resonant frequency $\omega_c$. In this case, $L_c$, $C_c$, $Z_0$, and $\beta l$ have the following relations.

$$\omega L_c = \frac{Z_0}{2}\left(\frac{\beta l}{\sin^2 \beta l} - \cot \beta l\right) \quad (10)$$

$$\frac{1}{\omega C_c} = \frac{Z_0}{2}\left(\frac{\beta l}{\sin^2 \beta l} + \cot \beta l\right) \quad (11)$$

Further, if $\omega=\omega_c=2\pi f_c$ and $\beta l=(2n-1)\pi/2$, the $L_c$ and $C_c$ become:

$$L_c = \frac{Z_0(2n-1)}{8f_c}, \quad C_c = \frac{2}{Z_0 \pi^2 f_c(2n-1)} \quad (12)$$

If $Z_0=50\ \Omega$, $f_c=1.5$ GHz, then $L_c$ and $C_c$ become $L_c=4.16$ nH and $C_0=2.70$ pF respectively.

Thus, the equivalent circuit is primarily capacitive at a frequency under the 1.5 GHz. For example, if f=800 MHz, an equivalent capacitance C becomes:

$$C = \frac{C_c}{1-\omega^2 L_c C_c} = 3.8 \text{ pF} \quad (13)$$

It is therefore apparent from the above that it is possible to produce inductance or capacitance with a strip line.

In the first embodiment, a short circuited strip line which has $\frac{1}{4}$ wave length is provided, and according to equation (6), both the equivalent inductance $L_c$ and the equivalent capacitance $C_c$ of the equivalent circuit become:

$$L_c = \frac{2Z_0}{\pi^2 f_c}, \quad C_c = \frac{1}{8f_c Z_0} \quad (14)$$

For example, in case that $Z_O=10.0\ \Omega$ and $f_c=881.0$ MHz, the $L_c$ becomes 2.3 nH and the $C_c$ becomes 14.1 pF.

Further, if a coupling capacitance is formed by a pair of spaced apart opposing metal capacitor plates (electrodes) with dielectric material filling the space between them, then the capacitance is given by the following equation:

$$C = 0.0855\epsilon_r \frac{A}{t} \ (pF) \quad (15)$$

where A is the area of the capacitor plates ($cm^2$), t is the distance between the plates (cm), and $\epsilon_r$ is the specific inductive capacity of the dielectric material between the plates. For example, in the first embodiment, $\epsilon_r$ is 4.5 and t is 0.1 cm, and for each of capacitors 15, 17 and 19 in FIG. 3(*a*), A is 0.45 $cm^2$ (0.67 cm by 0.67 cm), and therefore, the capacitance of each capacitor is about 1.72 pF.

As to each of the other coupling capacitors 25, 29, and 33, the distance t in the above equation is equivalent to a perpendicular distance between the line-shaped electrodes. Thus, for the capacitors 25, 33 in FIG. 3(*a*) comprising a pair of line-shaped electrode (22, 24) and (30,32) respectively, the area A is 0.025 $cm^2$ (1.25 cm by 0.02 cm) and the distance t is 0.02 cm, and therefore the capacitance is about 0.49 pF. For the capacitor 29 comprising a pair of electrodes (26, 28), the area A is 0.039 $cm^2$ (0.962 cm by 0.02 cm) and the distance t is 0.02 cm, and therefore the capacitance is 0.37 pF.

Figure 5:
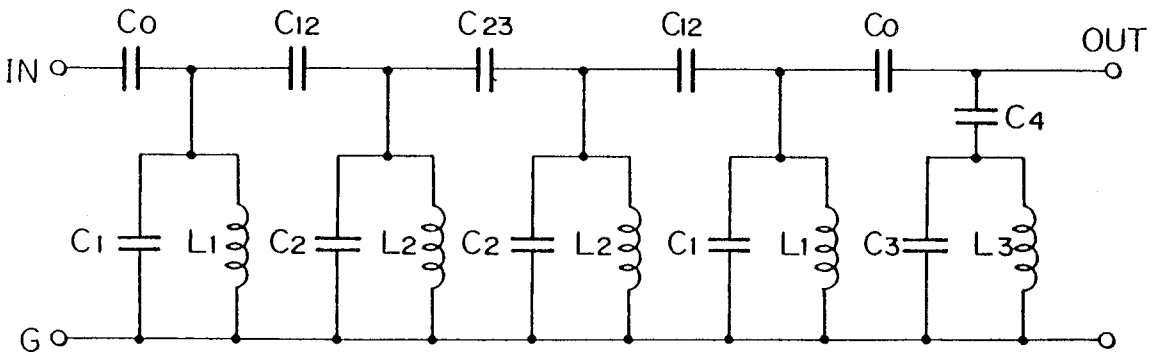
FIG. 5 is an equivalent circuit diagram of the first embodiment.

The equivalent circuit of the first embodiment has a circuit diagram as shown in FIG. 5. According to an experiment performed by the inventors, after final tuning by trimming away portions of the plated electrodes and strip lines, the value of each of the elements in FIG. 5 becomes as follows:

$C_0 = 1.72$ pF $C_1 = 12.2$ pF $C_2 = 13.3$ pF $C_3 = 12.2$ pF $C_4 = 1.12$ pF $C_{12} = 0.49$ pF $C_{23} = 0.37$ pF $L_1 = L_2 = L_3 = 2.3$ nH

According to a result of the experiment, the volume of the first embodiment of the invention is almost half that of the above described first example of a conventional filter, which is illustrated in FIG. 1. Further, according to the above experiment, the Q (Quality factor) of the first embodiment of the invention is approximately 500, which is a sufficient value to be used in 800 MHz band mobile communications.

Figure 4A:
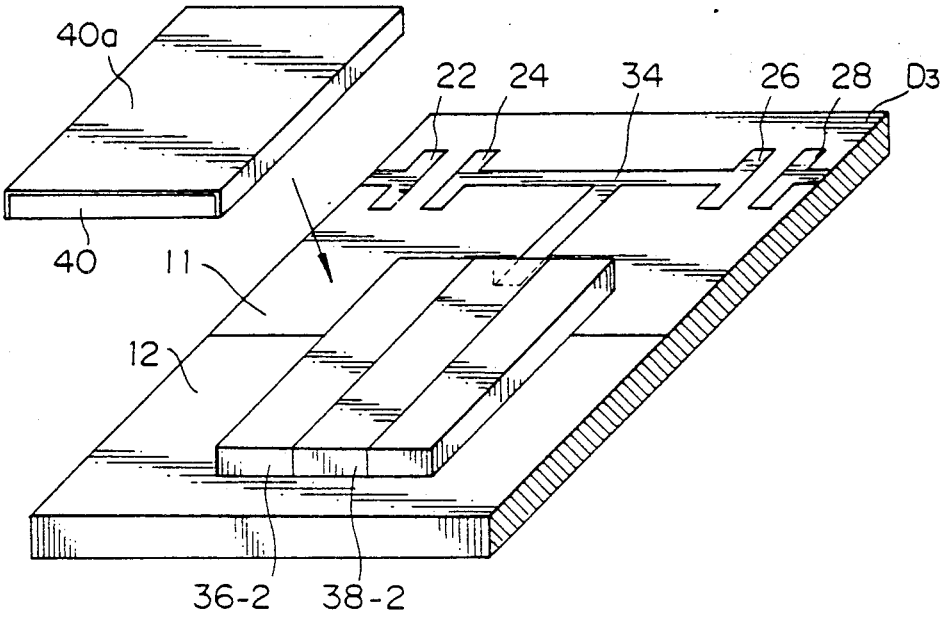
FIG. 4(*a*) is an exploded view of a modification of the first embodiment.
Figure 4B:
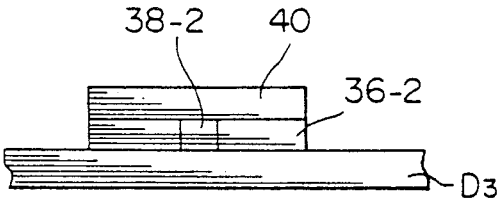

FIG. 4(*a*) is an exploded partial sectional view of a modification of the first embodiment. As is well known in microwave technology, if a strip line circuit is covered by a dielectric material which has relatively high specific inductive capacity (dielectric constant), the circuit will be a relatively low-loss circuit. In this modification, the top surface of each resonator portion comprising a combination of a strip line 38-*n* and a dielectric block 36-*n* (n=1, 2, . . . 5), for example, strip line 38-2 and dielectric block 36-2 which are shown in FIG. 4(*a*), is covered by a separate dielectric plate 40 which has approximately the same size as the dielectric block and all of whose surfaces except the bottom, front, and back surfaces are covered with a plating 40*a*. By providing those dielectric plates 40, the loss of the filter will be reduced and the quality factor of the filter is increased.

Second Embodiment

Figure 6A:
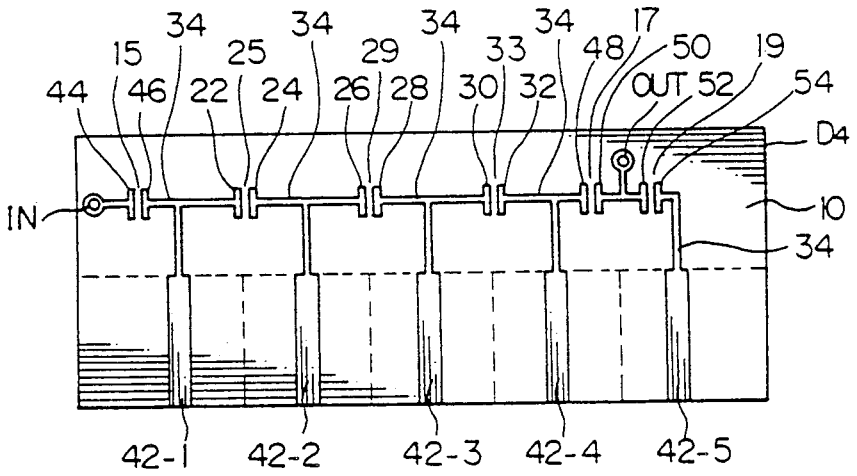
FIG. 6(*a*), FIG. 6(*b*), and FIG. 6(*c*) are respectively upper, side, and reverse side views of a second embodiment of the invention.
Figure 6B:
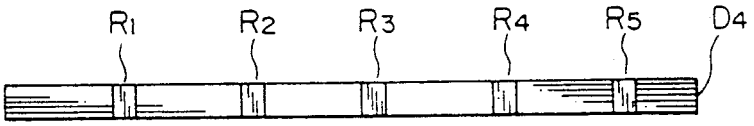
Figure 6C:
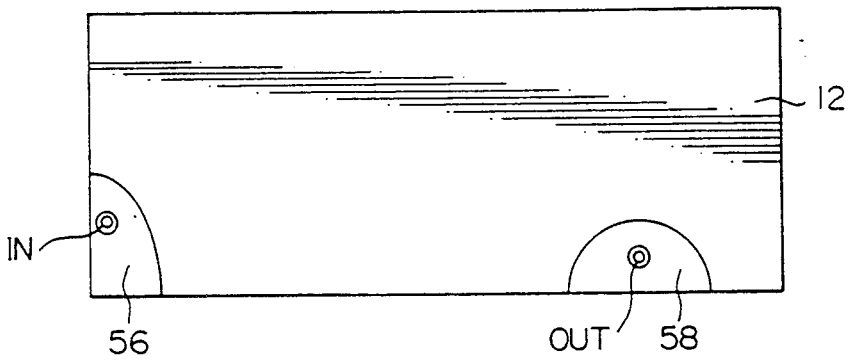

FIG. 6(*a*), FIG. 6(*b*), and FIG. 6(*c*) illustrate a second embodiment of the invention. In those figures, the same reference numerals denote the same or equivalent elements as illustrated in FIG. 3(*a*), 3(*b*), and 3(*c*). In this embodiment, the glass-epoxy circuit board $D_3$ featured in the first embodiment is replaced with a ceramic dielectric plate $D_4$ which has relatively high specific inductive capacitance.

According to this structure, the resonator portions $R_n$ (n=1, 2, . . . 5) can be put directly on the dielectric plate $D_4$, whereby the total size of the filter can be further reduced. However, as described with respect to the first embodiment, the higher specific inductive capacity dielectric material is more costly, so the cost of the filter will therefore increase since the embodiment requires a great amount of the more expensive dielectric material.

As shown in FIG. 6(*a*), there are provided strip lines 42-*n* (n=1, 2, . . . 5) directly on the upper surface of the dielectric plate $D_4$, and those strip lines 42-*n* and regions around the strip lines which are illustrated by broken lines define the resonators $R_n$ (n=1, 2, . . . 5). On the other hand, as shown in FIG. 6(*c*), the reverse side of the dielectric plate D4 is entirely covered by a metalized portion 12 except two exposed portions 56 and 58 around the input terminal IN and the output terminal OUT.

Since all of filter elements, such as the strip lines 42-*n* (n=1, 2, . . . 5), the coupling capacitances 15, 25, 29, 33, 17, and 19, the metalized portion for grounding 12, input terminal (through hole) IN, output terminal OUT, and printed circuits 34 can be made in one step by the same technique, for example, by plating, even though the cost of the dielectric material may be high, the total manufacturing cost of the filter can be reduced by mass-production.

Moreover in this embodiment, in contrast to the embodiment illustrated in FIGS. 3(*a*)–3(*c*), because the dielectric plate $D_4$ has relatively high specific inductive capacitance, the coupling capacitors 15 and 17, that is, the capacitors having capacitances $C_0$ and the capacitor 19, that is the capacitor having the caspacitance $C_4$, can be made in the same way as the other coupling capacitors including the two capacitors 25 and 33 having the capacitance $C_{12}$ and the capacitor 29 having the capacitance $C_{23}$.

Figure 7A:
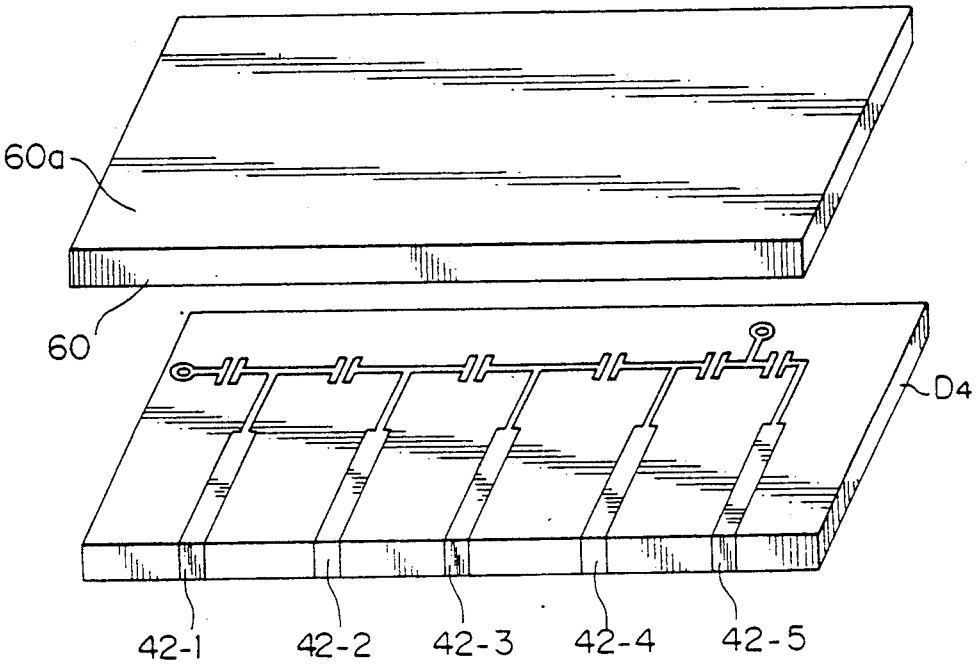
FIG. 7(*a*) is an exploded view of a modification of the second embodiment.
Figure 7B:
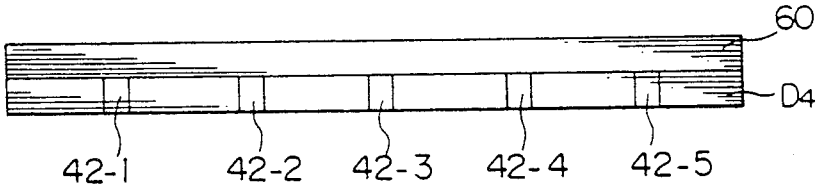

FIG. 7(*a*) and FIG. 7(*b*) illustrate a modification of the second embodiment of the invention similar to that shown in FIGS. 4(*a*) and 4(*b*). As shown in FIGS. 7(*a*) and 7(*b*), the entire dielectric plate $D_4$ is covered by a ceramic dielectric plate 60 which is approximately the same size as the dielectric plate $D_4$ and all of whose surfaces except the front and bottom surfaces are covered with metal plating 60*a*. According to this modification, there can be obtained a low-loss, high Q-filter.

Third Embodiment

Figure 8A:
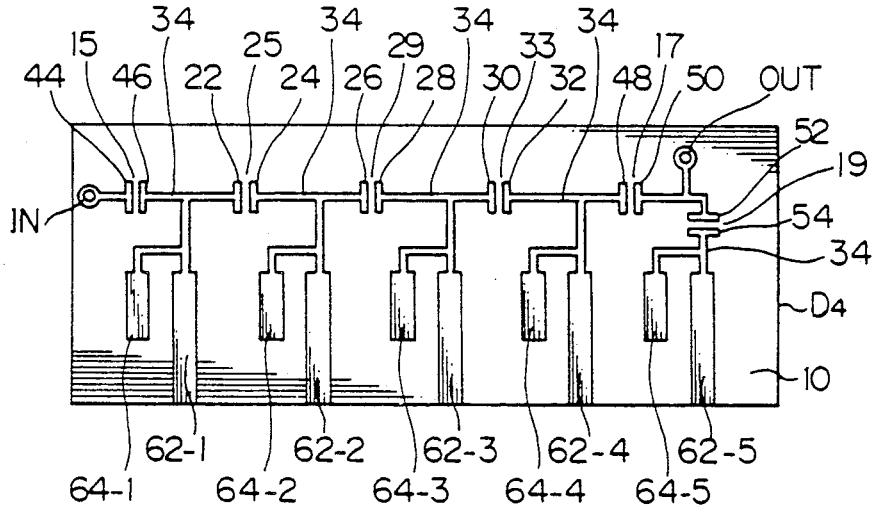
FIG. 8(*a*), FIG. 8(*b*), and FIG. 8(*c*) are respectively upper, side, and reverse side views of a third embodiment of the invention.
Figure 8B:
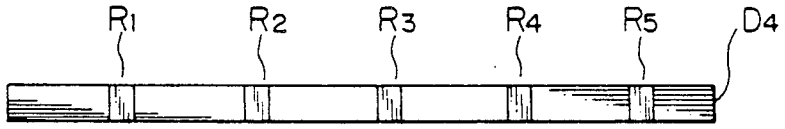
Figure 8C:
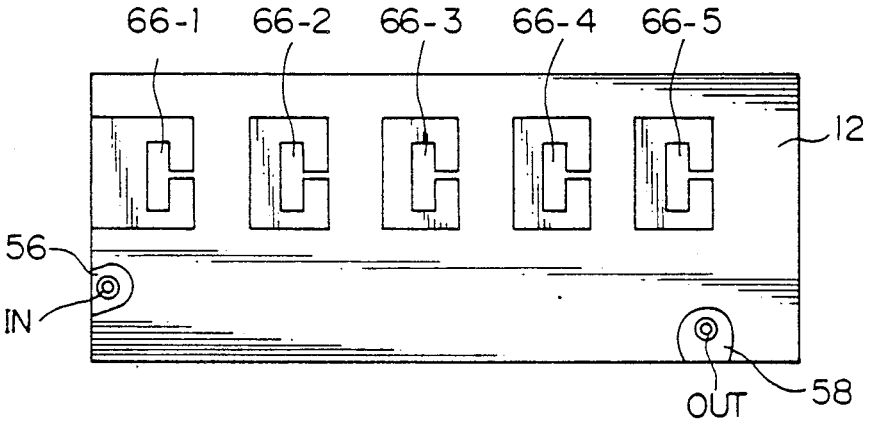

FIG. 8(*a*), FIG. 8(*b*), and FIG. 8(*c*) illustrate a third embodiment of the invention. In this embodiment, inductance components or resonators $R_n$, such as inductances L1, L2, and L3, are formed by strip lines 62-*n* (n=1, 2, . . 5), and capacitance components of the resonators $R_n$, such as capacitances C1, C2, and C3, are comprised of respective combinations of opposing electrodes 64-*n* and 66-*n* (n=1, 2, . . . 5) on opposite side of the dielectric plate D4. Of course, an equivalent circuit of this embodiment is the same equivalent circuit as that for the other embodiments, which is illustrated in FIG. 5.

An advantage of this embodiment is that it is easy to perform fine tuning of each components of the resonators by trimming.

Fourth Embodiment

Figure 9A:
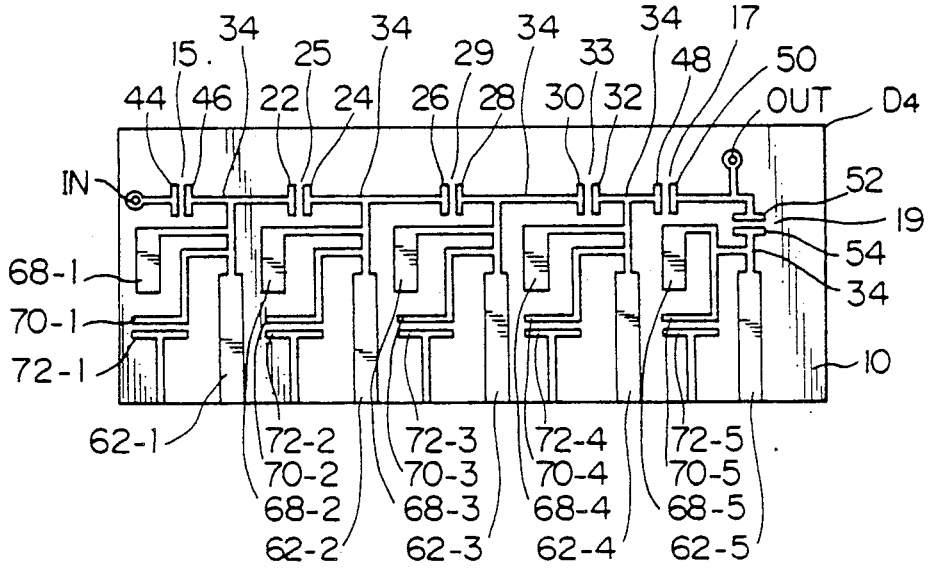
FIG. 9(*a*), FIG. 9(*b*), and FIG. 9(*c*) are respectively upper, side, and reverse side views of a fourth embodiment of the invention.
Figure 9B:
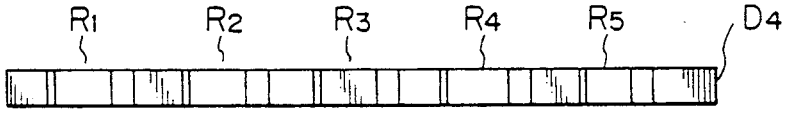
Figure 9C:
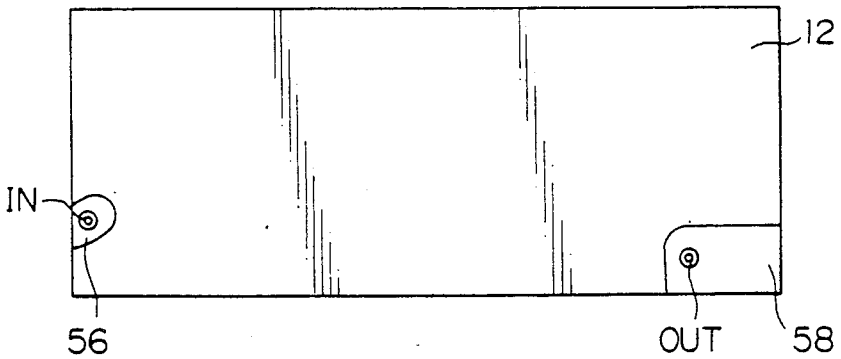

FIG. 9(*a*), FIG. 9(*b*), and FIG. 9(*c*) illustrate a fourth embodiment of the invention. In this embodiment the capacitance components of the resonators of the third embodiment illustrated in FIGS. 8(*a*)–8(*c*) are divided into a combination of an electrode 68-*n* and an opposite pair of electrodes 70-*n* and 72-*n* (n=1, 2, . . . 5). The electrodes 68-*n* are rectangular metalized portions and each pair of electrodes 70-*n* and 72-*n* (n=1, 2, . . . 5) is a pair of parallel line electrodes. These combinations form parallel capacitances in each of resonators $R_n$ (n=1, 2, . . . 5).

According to this embodiment, it is easy to tune the capacitance components with relatively high sensitivity. Further, it is apparent that the same advantages discussed above which are obtained with the embodiment illustrated in FIGS. 7(*a*) and 7(*b*) can be obtained also with the embodiments illustrated in FIGS. 8(*a*)–8(*c*) and 9(*a*)–9(*c*).

Fifth Embodiment

Figure 10:
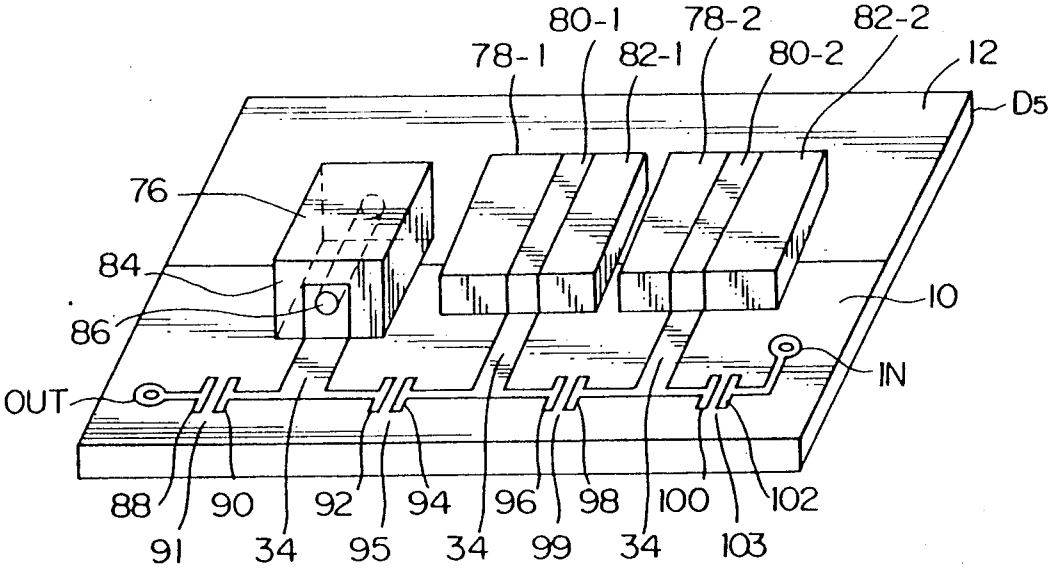
FIG. 10 is a perspective view of a fifth embodiment of the invention.
Figure 11:
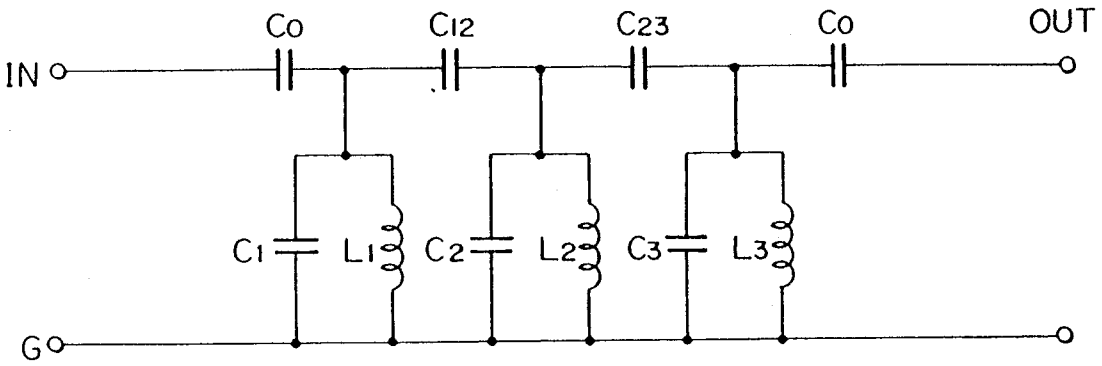
FIG. 11 is an equivalent circuit diagram of the fifth embodiment of the invention.

FIG. 10 illustrate a fifth embodiment of the invention and FIG. 11 illustrates an equivalent circuit of the fifth embodiment. As shown in FIG. 10, the filter according to this embodiment comprises a combination of a rectangular coaxial resonator 76 corresponding to $L_1$ and $C_1$ in FIG. 11, a glass-epoxy dielectric plate $D_5$, a resonator 78-1 corresponding to $L_2$ and $C_2$, and a resonator 78-2 corresponding to $L_3$ and $C_3$, resonators 78-1 and 78-2 are the same resonators as in FIG. 3(*a*) for the first embodiment of the invention. Of course, each of the resonators 78-1 and 78-2 is comprised of a respective combination of a dielectric ceramic block 80-*m* and a strip line 82-*m* on the ceramic block. (m=1, 2).

The coaxial resonator 76 is a conventional type dielectric resonator and includes a relatively large dielectric ceramic block 84 having a through hole 86 whose interior surface is metalized. As shown in FIG. 10, the entire surface of the block 84 except its front surface is metal plated and the interior metalized portion is connected to coupling capacitors 91 and 95 via printed circuit 34. In the same manner as the other embodiments, each of the other coupling capacitors, including capacitor 95 of capacitance $C_1$, capacitor 99 of capacitance $C_2$, and capacitor 103 of capacitance $C_0$, is comprised of a combination of a pair of printed line electrodes, 88 and 90, 92 and 94, 96 and 98, and 100 and 102, respectively.

Since the coaxial resonator has a relatively higher quality factor than the strip line resonator, it would be able to realize a high Q filter.

What is claimed is:

1. An LC-type filter, comprising:

a. a dielectric plate having a first dielectric constant and including a first upper surface;

b. a conductive layer on a portion of said first upper surface, said conductive layer forming a ground portion;

c. a microstrip resonator, including (1) a first rectangular dielectric block having a second dielectric constant which is higher that said first dielectric constant, said first dielectric block including i. a lower surface at least a part of which lies on said ground portion, ii. a second upper surface which is parallel to said first upper surface, iii. opposite first and second side surfaces, and iv. opposite front and back surfaces, and (2) a first strip line formed on center portions of said front, back and second upper surfaces midway between said first and second side surfaces, said first strip line having a first end on said front surface and connected to said ground portion and a second end on said back surface;

d. first and second metal layers respectively completely covering said first and second side surfaces so as to be disposed symmetrically with respect to said first strip line and connected to said ground portion;

e. a third metal layer covering all of said lower surface except a small exposed area of said lower surface abutting said second end of said strip line so as to separate said second end from said third metal layer, said exposed area being spaced from said first and second side surfaces; and f. a printed circuit on said plate, said printed circuit including (1) an input terminal, (2) an output terminal, (3) a first coupling circuit coupling said second end of said first strip line to said input terminal, and (4) a second coupling circuit coupling said second end of said first strip line to said output terminal.

2. An LC-type filter according to claim 1, further comprising a second resonator, including a second rectangular dielectric block on said dielectric plate and a second strip line on said second dielectric block, said second strip line having a first end connected to said ground portion and a second end, said printed circuit further comprising a third coupling circuit coupling together the second ends of said first and second strip lines.

3. An LC-type filter according to the claim 1, wherein said first and second resonators are oriented side-by-side with said first and second strip lines parallel to each other, the first ends of the strip lines adjacent to each other, the second ends of the strip lines adjacent to each other.

* * * * *